US009145193B2

(12) United States Patent
Sugiyama

(10) Patent No.: US 9,145,193 B2
(45) Date of Patent: Sep. 29, 2015

(54) COOLING WATER PASSAGE STRUCTURE OF OUTBOARD MOTOR

(71) Applicant: SUZUKI MOTOR CORPORATION, Hamamatsu-shi, Shizuoka (JP)

(72) Inventor: Shuichi Sugiyama, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 254 days.

(21) Appl. No.: 13/681,883

(22) Filed: Nov. 20, 2012

(65) Prior Publication Data

US 2013/0149920 A1 Jun. 13, 2013

(30) Foreign Application Priority Data

Nov. 22, 2011 (JP) ..... 2011-255293
Nov. 22, 2011 (JP) ..... 2011-255294

(51) Int. Cl.
*B63H 20/00* (2006.01)
*B63H 20/28* (2006.01)
*F01P 3/20* (2006.01)

(52) U.S. Cl.
CPC ..... *B63H 20/28* (2013.01); *B63H 20/001* (2013.01); *B63H 20/285* (2013.01); *F01P 3/202* (2013.01)

(58) Field of Classification Search
CPC ..... B63H 20/28; B63H 20/285; B63H 20/30; B63H 20/001; F01P 3/202
USPC ..... 440/88 M, 88 R, 88 C
See application file for complete search history.

(56) References Cited

U.S. PATENT DOCUMENTS 4,832,640 A * 5/1989 Karls ..... 440/88 M
5,902,160 A * 5/1999 Weronke et al. ..... 440/88 M
6,068,529 A * 5/2000 Weronke et al. ..... 440/88 M
6,146,223 A * 11/2000 Karls et al. ..... 440/88 R

FOREIGN PATENT DOCUMENTS

JP S61-55000 4/1986
JP 03273997 A * 12/1991 ..... B63H 21/26

* cited by examiner

*Primary Examiner* — Ajay Vasudeva
(74) *Attorney, Agent, or Firm* — Troutman Sanders LLP

(57) ABSTRACT

An outboard motor has a driveshaft and a propeller shaft connected to each other while placing gears in between in a casing of a lower unit. A cooling water passage structure of the motor has main water intakes provided on the left and right of the casing, a cooling water passage which guides therethrough water taken up through the main water intakes to a cooling water pump, and sub water intakes disposed on the left and right of the pointed portion of the gear case provided to the casing to give an appearance of bullet in the front-back direction. The sub water intake on the left is allowed to communicate through a left cooling water passage with the main water intake on the left. The sub water intake on the right is allowed to communicate through a right cooling water passage with the main water intake on the right.

6 Claims, 11 Drawing Sheets

COOLING WATER PASSAGE STRUCTURE OF OUTBOARD MOTOR

CROSS-REFERENCE TO RELATED APPLICATIONS

This application is based upon and claims the benefit of priority of the prior Japanese Patent Application No. 2011-255293, filed on Nov. 22, 2011, and the prior Japanese Patent Application No. 2011-255294, filed on Nov. 22, 2011, the entire contents of which are incorporated herein by reference.

BACKGROUND OF THE INVENTION

1. Field of the Invention

The present invention relates to a cooling water passage structure of an outboard motor suitable for taking water up from external water.

2. Description of the Related Art

In one known example of cooling water passage structure of outboard motor such as disclosed in Patent Document 1, a main water intake is provided to the side face of a gear case, so as to guide water from the main water intake to a main water passage. A water reservoir is formed to the gear case at a position thereof above a propeller, so as to guide water from the water reservoir through a pipe to the main water passage. In this way, shortage of intake of cooling water taken up through the main water intake for cooling an engine, possibly due to clogging of the main water intake with by algae or the like, may be supplemented.

[Patent Document 1] Japanese Laid-Open Utility Publication No. S61-55000

SUMMARY OF THE INVENTION

The outboard motor disclosed in Patent Document 1 has the pipe which guides therethrough water from the water reservoir above the propeller to the main water passage. For implementation of another design such that additional water intake besides the main water passage is disposed at any position of the gear case different from the position above the propeller, it may however be difficult to dispose a pipe and water passage for guiding water from the additional water intake to the main water passage, for the reason of structure of the gear case.

The present invention was conceived to address the above-described problem, and an object of which is to ensure a sufficient degree of freedom of layout, for a new arrangement of one water intake and the other water intake.

According to the present invention, there is provided a cooling water passage structure of an outboard motor configured so that a driveshaft and a propeller shaft are connected while placing gears in between in a lower casing, the cooling water passage structure comprising: first water intakes provided on the left and right of the lower casing; a cooling water passage which guides therethrough water taken up through the first water intakes to a cooling water pump; one or more second water intakes provided to the lower casing, and disposed ahead of the first water intakes; and a left cooling water passage which allows the second water intake to communicate with the first water intake on the left, and a right cooling water passage which allows the second water intake to communicate with the first water intake on the right.

DETAILED DESCRIPTION OF THE PREFERRED EMBODIMENTS

Preferred embodiments of the present invention will be explained referring to the attached drawings.

First Embodiment

Figure 1:
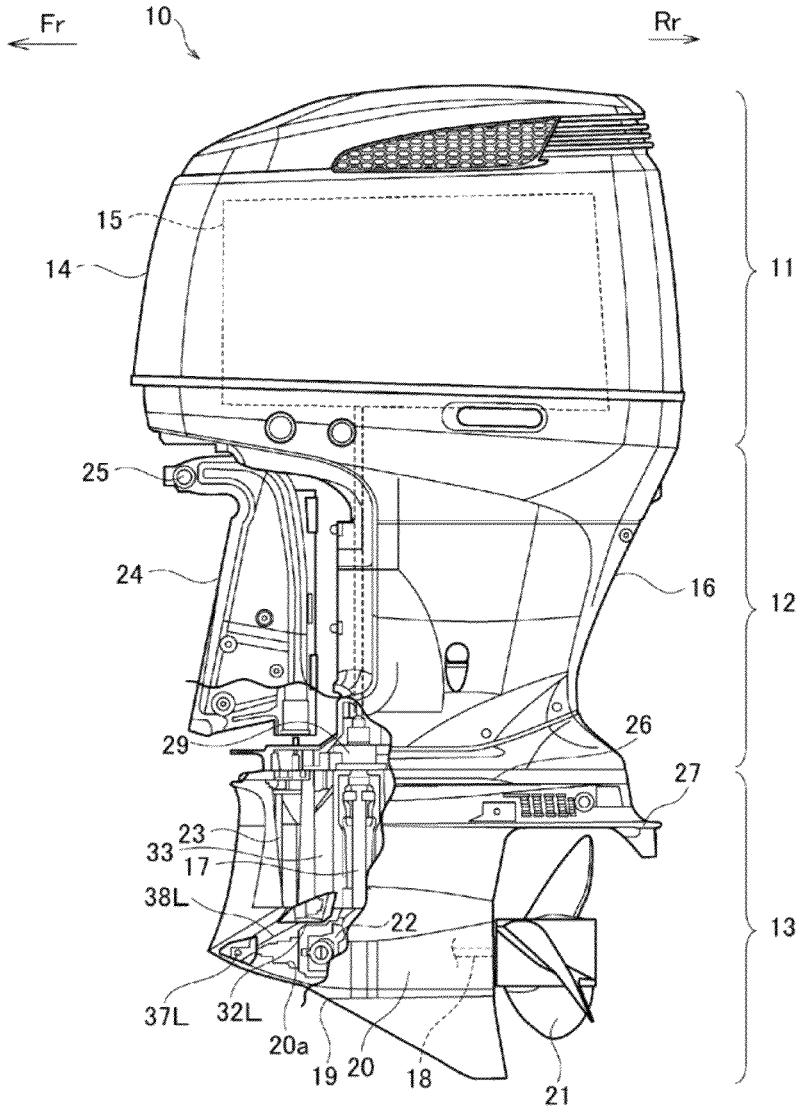
FIG. 1 is a partially exploded left side elevation of an outboard motor according to a first embodiment.

FIG. 1 is a partially exploded left side elevation of an outboard motor 10 of this embodiment. In the present invention, front, rear, left and right directions are defined in a state the outboard motor is attached to a hull, with optional indication of arrow Fr for the front of the outboard motor 10, and arrow Rr for the rear.

In the overall configuration of the outboard motor 10, an engine unit 11, a mid unit 12 and a lower unit 13 are arranged in this order from the top to the bottom.

In the engine unit 11, an engine 15 is vertically mounted and supported by a casing 14, so that a crankshaft is aligned perpendicularly. The engine 15 adoptable herein is a multi-cylinder V engine, for example.

In the mid unit 12, a driveshaft 17 coupled to the crankshaft of the engine 15 is disposed so as to vertically penetrate a casing 16, thereby motive force of the driveshaft 17 is transmitted through gears 11 in the lower unit 13 to a propeller shaft 18. The mid unit 12 also has provided thereto an oil pan for reserving oil for lubricating the engine unit 11.

In the lower unit 13, a casing 19 has provided therein a gear case 20 disposed to give an appearance of bullet in the front-back direction. In a housing 20*a* of the gear case 20, enclosed are a plurality of gears 22 for rotating the propeller shaft 18 and a propeller 21. The driveshaft 17 extended downward from the mid unit 12 has a gear attached thereto, and the gear engages with one of the gears 22 in the housing 20*a* so as to rotate the propeller shaft 18, and finally to rotate the propeller 21. Power transmission route of a gear device in the gear case 20 may be switched, or shifted, by an operation of a shift rod composed of an unillustrated upper shift rod which extends vertically from the engine 15 side, and a lower shift rod 23 which vertically extends through, and supported by, a pointed end side of the gear case 20.

The thus-configured outboard motor 10 is supported by a bracket 24 in a laterally swingable manner, and fixed to a stern plate of the hull so as to be vertically pivotable around a tilting axis 25.

A cooling water passage structure of the outboard motor 10 of this embodiment will be explained below.

Figure 2:
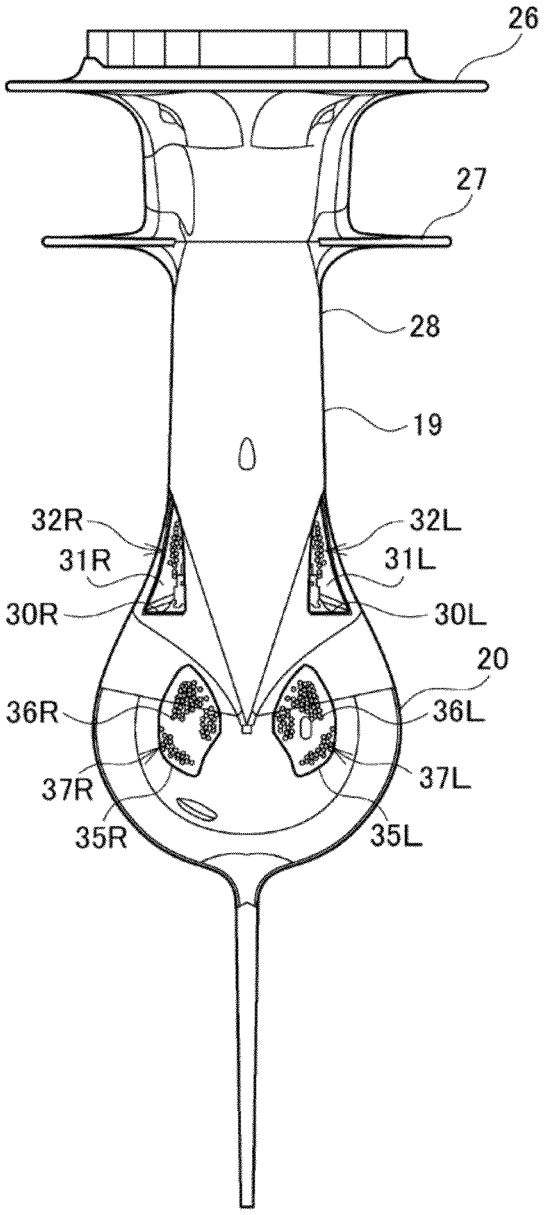
FIG. 2 is a front view of a lower unit of the outboard motor according to the first embodiment.
Figure 5:
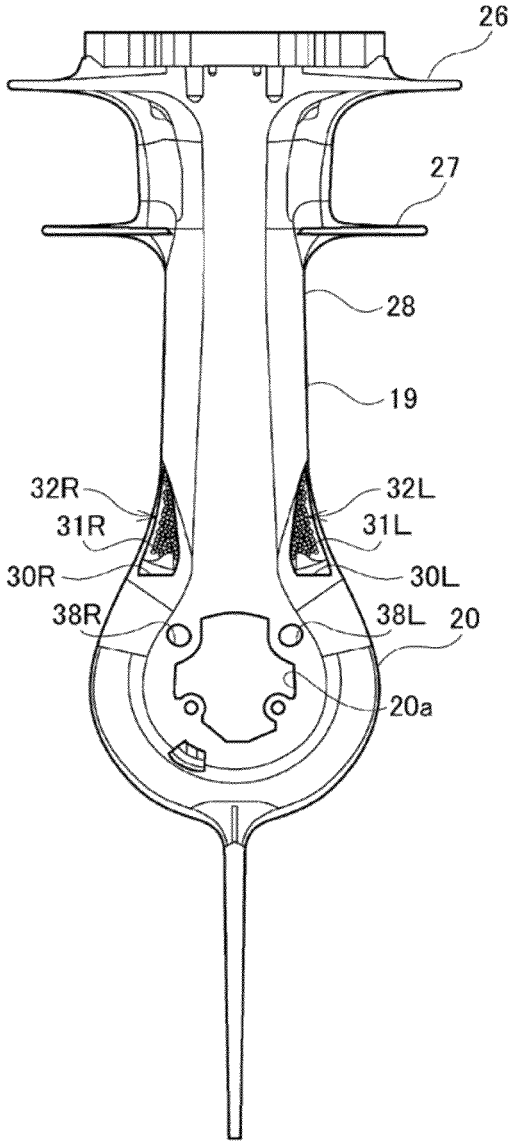
FIG. 5 is a cross sectional view taken along line V-V in FIG. 4.
Figure 6:
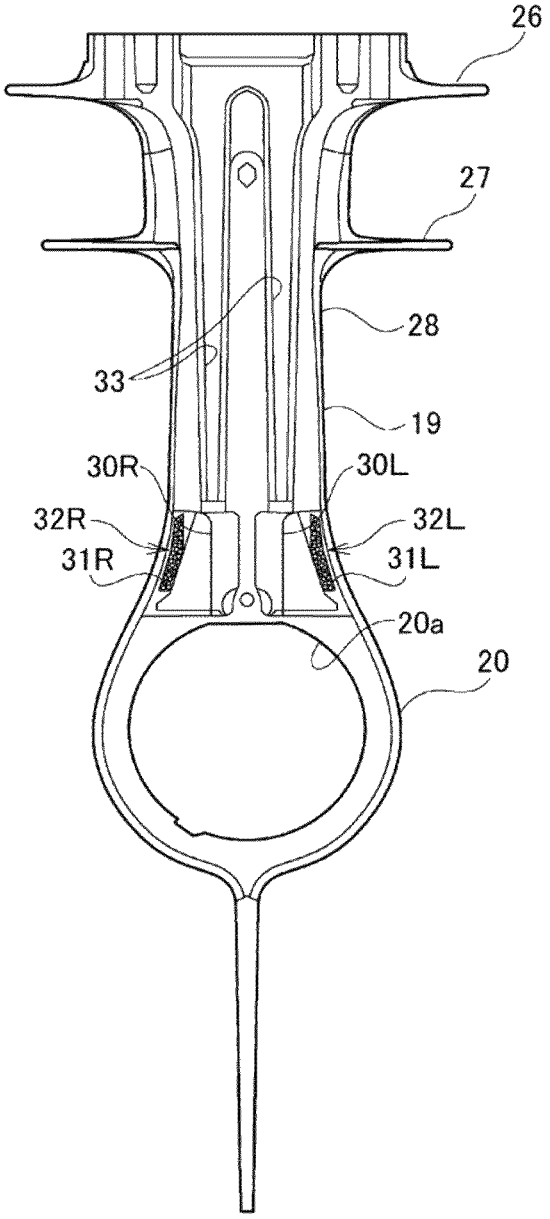
FIG. 6 is a cross sectional view taken along line VI-VI in FIG. 4.

FIG. 2 is a front elevation of the lower unit 13. The casing 19 of the lower unit 13 corresponds to the lower casing in the context of the present invention, and has an anti-splash plate 26 and an anti-cavitation plate 27 which are arranged so as to be spaced vertically at around the face to be mated with the mid unit 12. Below a stem 28 which extends downward, provided is a gear case 20 disposed to give an appearance of bullet in the front-back direction. In the gear case 20, as illustrated in FIGS. 5 and 6, there is formed a housing 20*a* which houses a plurality of gears 22 and so forth for rotationally driving the propeller shaft 18 and the propeller 21.

As illustrated in FIG. 1, a cooling water pump 29 is attached to the upper surface of the casing 19 of the lower unit 13, so as to be axially supported by the driveshaft 17. The cooling water pump 29 operates as the driveshaft 17 rotates, takes water up from the external of the outboard motor 10, and feeds cooling water towards the engine unit 11.

Figure 3:
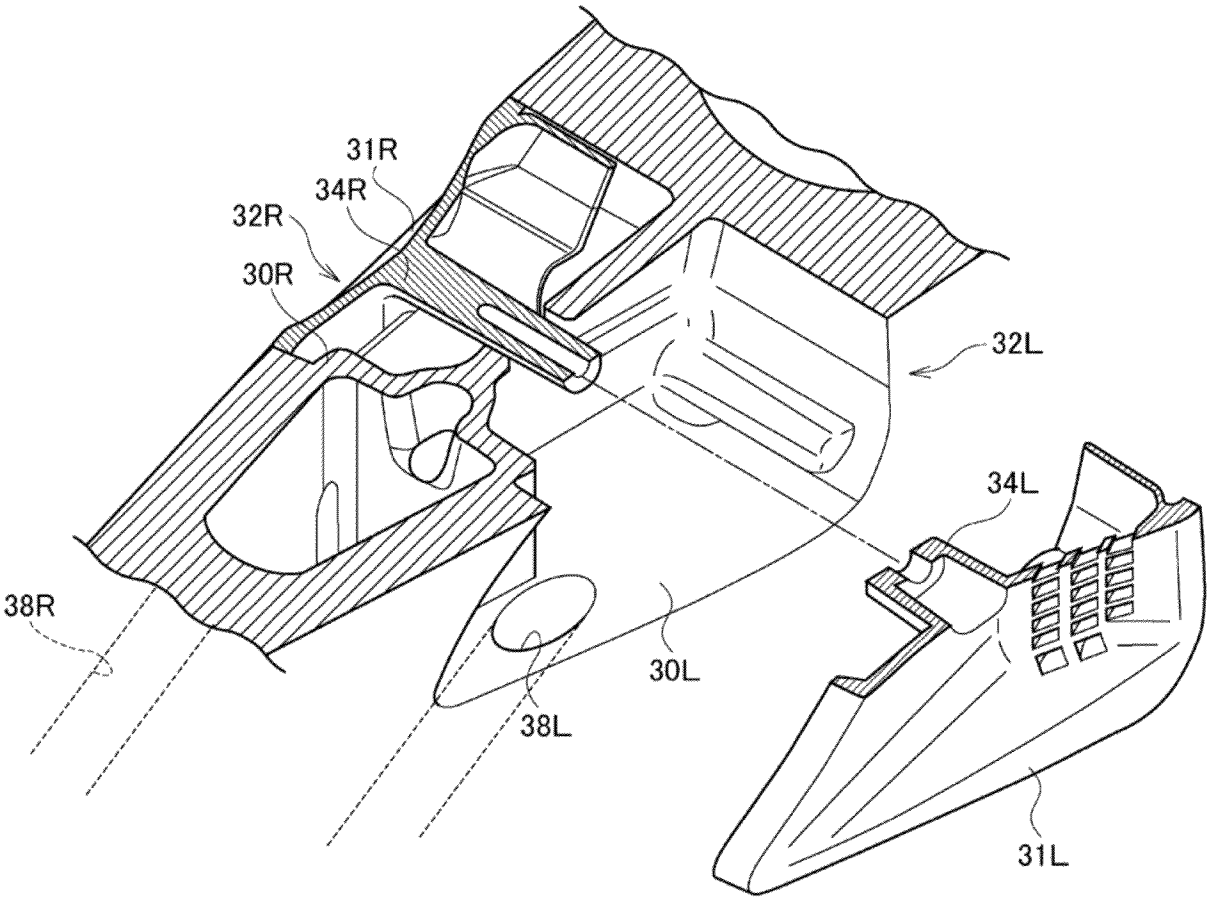
FIG. 3 is a perspective view illustrating a configuration of a main water intake in the first embodiment.

Now, on the left and right of the casing 19, and at positions where the gear case 20 integrates with the stem 28, there are formed main water inlets 30L, 30R. As illustrated in FIG. 3, the main water inlets 30L, 30R are attached with covers 31L, 31R, respectively. A filter is provided to a large number of water inlet holes formed in the covers 31L, 31R, so as to allow them to function as a filter for removing foreign matters. The main water inlets 30L, 30R are shaped so as to be recessed inward, and the covers 31L, 31R are attached so as to close the main water inlets 30L, 30R, respectively, to thereby configure the main water intakes 32L, 32R which correspond to the first water intakes in the context of the present invention. In other words, the main water intakes 32L, 32R are configured to form therein spaces by the cooperation of the covers 31L, 31R and the main water inlets 30L, 30R.

In this embodiment, the covers 31L, 31R are designed, when fitted to the main water inlets 30L, 30R, to bring bosses 34L, 34R provided to the covers 31L, 31R into contact with each other. By fastening the bosses 34L, 34R together in this state using an unillustrated bolt, both covers 31L, 31R are fixed.

As illustrated in the side elevation of FIG. 1, the main water intakes 32L, 32R are disposed between the driveshaft 17 and the lower shift rod 23. In the casing 19, there is formed a cooling water passage 33 which extends vertically between the driveshaft 17 and the lower shift rod 23 in the side view. By the cooling water passage 33, the main water intakes 32L, 32R and the cooling water pump 29 are connected.

On the left and right of the pointed portion of the gear case 20, there are formed sub water inlets 35L, 35R. Also the sub water inlets 35L, 35R are shaped so as to be recessed inward, to which the covers 36L, 36R for filtering off foreign matters and so forth are attached, to thereby configure sub water intakes 37L, 37R which correspond to the second water intakes in the context of the present invention. In other words, the sub water intakes 37L, 37R are configured to form therein spaces by the cooperation of the covers 36L, 36R and the sub water inlets 35L, 35R.

Figure 4:
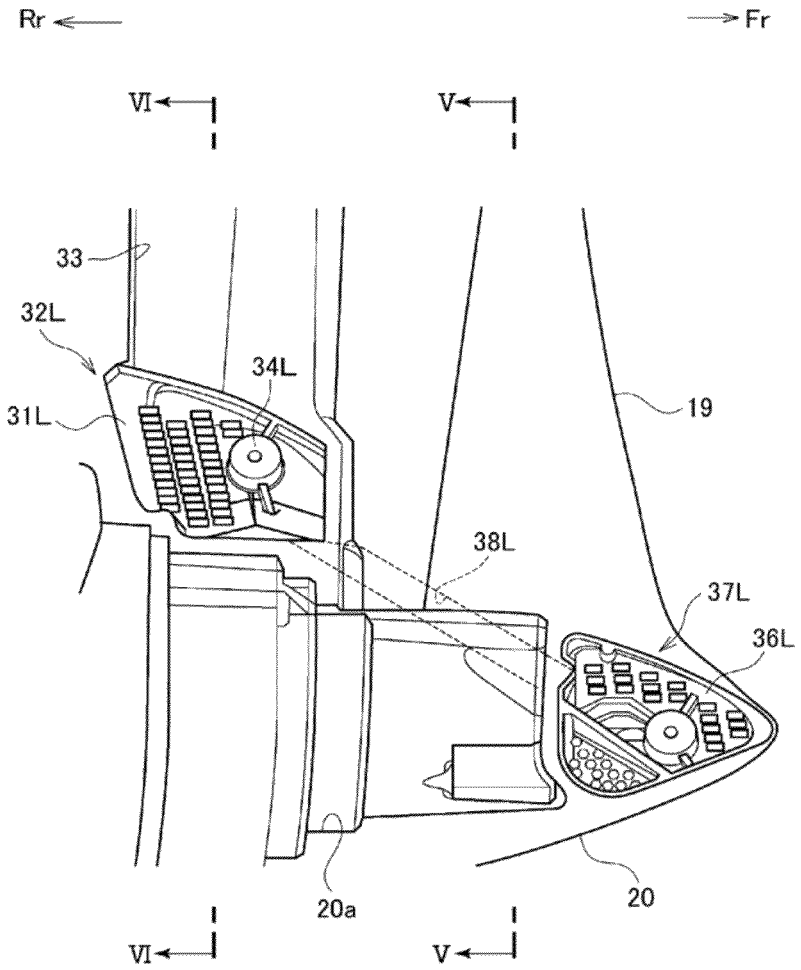
FIG. 4 is a drawing explaining positional relations among a main water intake, a sub water intake and a cooling water passage connecting them in the first embodiment.

As illustrated in FIGS. 3 to 5, on the left of the gear case 20, there is formed a left cooling water passage 38L which allows the sub water intake 37L on the left to communicate with the space in the main water intake 32L on the left. Similarly, on the right of the gear case 20, there is formed a right cooling water passage 38R which allows the sub water intake 37R on the right to communicate with the space in the main water intake 32R on the right. The main water intakes 32L, 32R are disposed on the side faces of the gear case 20 and above the housing 20*a*, whereas the sub water intakes 37L, 37R are disposed at a pointed portion of the gear case 20, so that the individual cooling water passages 38L, 38R are formed to rise rearward in the side view. In this case, while the left cooling water passage 38L and the right cooling water passage 38R overlap the housing 20*a* in the side view, they are independently routed on the left and right of the housing 20*a* so as to avoid interference with the housing 20*a*.

In the thus-configured cooling water passage structure of the outboard motor, the sub water intakes 37L, 37R are positioned on the upstream side of stream of water during cruising of the vessel, and the main water intakes 32L, 32R are positioned on the downstream side. The sub water intake 37L on the left is communicated in series through the left cooling water passage 38L to the main water intake 32L on the left, and the sub water intake 37R on the right is communicated in series through the right cooling water passage 38R to the main water intake 32R on the right. In this configuration, when the cooling water pump 29 operates as the driveshaft 17 rotates, water may be taken up through the main water intakes 32L, 32R, and fed through the cooling water passage 33 towards the engine unit 11. On the other hand, water may be taken up through the sub water intakes 37L, 37R, fed through the cooling water passages 38L, 38R towards the chamber-like main water intakes 32L, 32R, combined with water taken up through the main water intakes 32L, 32R, and fed together as cooling water through the cooling water passage 33 towards the engine unit 11.

As described in the above, by adopting such double-route configuration in which the sub water intake 37L on the left is communicated in series through the left cooling water passage 38L to the main water intake 32L on the left, and the sub water intake 37R on the right is communicated in series through the right cooling water passage 38R to the main water intake 32R on the right, it is no more necessary to provide a pipe or water passage for directly guiding water from the sub water intakes 37L, 37R to the cooling water passage 33, and thereby a sufficient degree of freedom of layout may be ensured.

Figure 7:
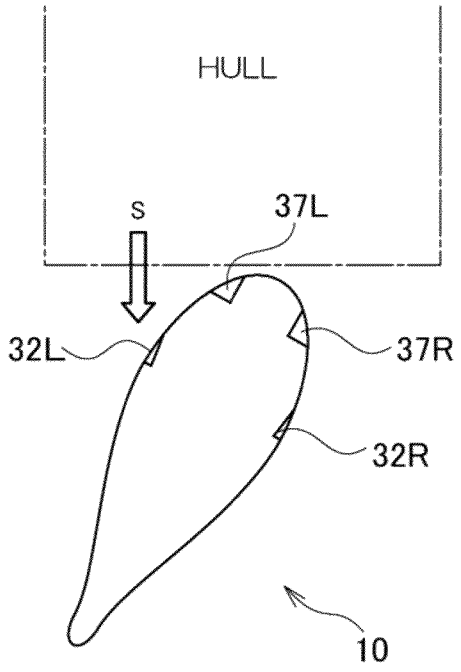
FIG. 7 is a drawing explaining operation achieved when the outboard motor is swung.

In addition, by adopting such double-route configuration of the cooling water passage structure, harm of abnormal water supply may be minimized. For example, when the outboard motor 10 is swung leftward or rightward by steering as illustrated in FIG. 7, one of the main water intakes 32L, 32R will be less likely to take up water. In the illustrated example, the main water intake 32L on the left side, which directly faced to stream of water (indicated by arrow S) is able to efficiently take up water, whereas the main water intake 32R on the right, which is positioned behind the stream of water is not able to efficiently take up water. Even in this state, water may be taken up through the sub water intakes 37L, 37R, so that shortage of the volume of water may be supplemented.

In addition, even if the filter is clogged by foreign matters in water in either of the main water intake 32L on the left side and the sub water intake 37R, water may be taken up through the other route, so that shortage of the volume of water may be supplemented. The same will apply also to the main water intake 32R on the right and the sub water intake 37L.

Moreover, by disposing the sub water intakes 37L, 37R at the pointed portion of the gear case 20, efficiency of water supply may be increased by dynamic pressure. In particular in the high speed region, the efficiency of water supply will decrease at the main water intakes 32L, 32R on the side faces of the casing 19, while being affected by separated flow of water. On the other hand, in the high-speed region, the efficiency of water supply will be peaked by the dynamic pressure at the sub water intakes 37L, 37R at the pointed portion of the gear case 20, so that it now becomes possible to avoid lowering in the efficiency of water supply in the high-speed region.

Second Embodiment

In the second embodiment, an exemplary case where the efficiency of water supply is further improved will be explained. Note that the overall configuration of the outboard motor and the basic configuration of the water supply passage are same as those in the first embodiment. All constituents same as those in the first embodiment will be given same reference numerals or symbols, and the description will be concentrated on difference from the first embodiment.

Figure 8:
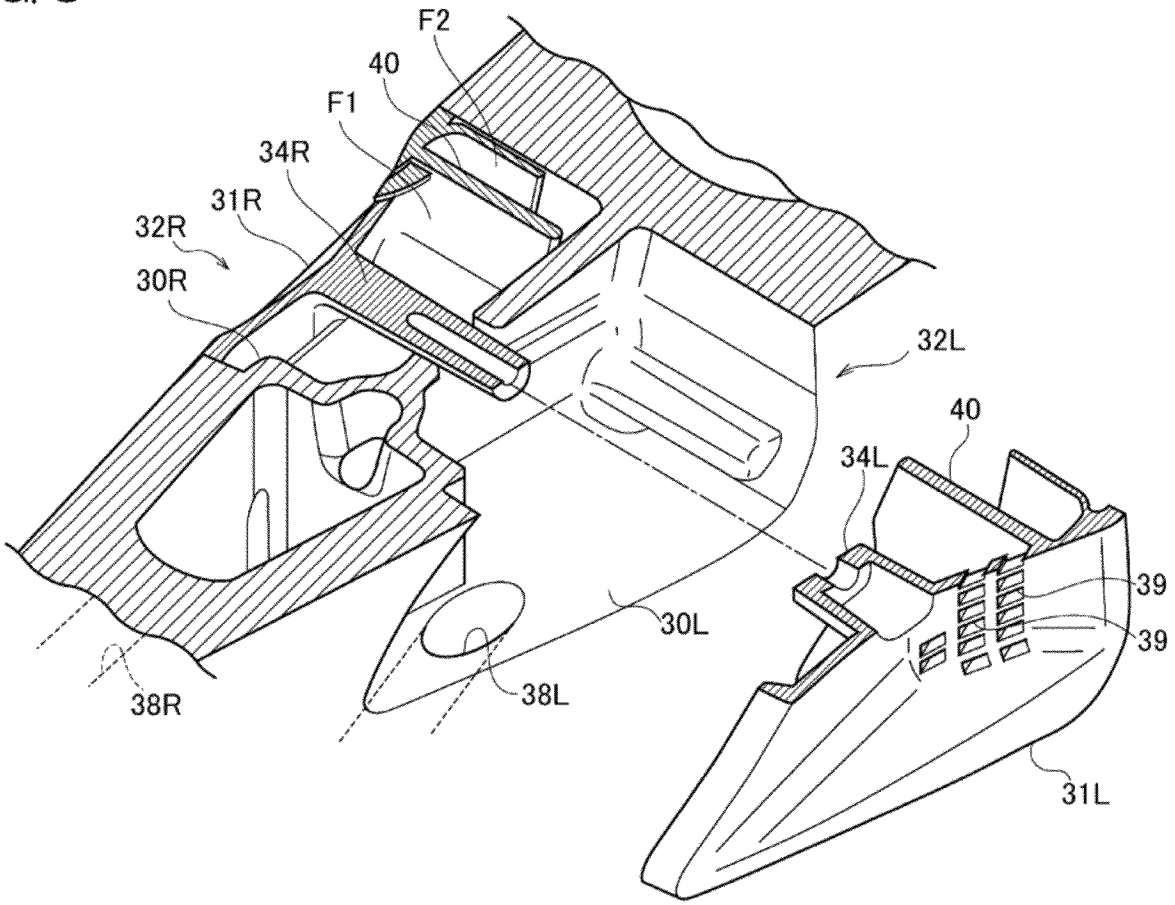
FIG. 8 is a perspective view illustrating a configuration of a main water intake in a second embodiment.
Figure 9B:
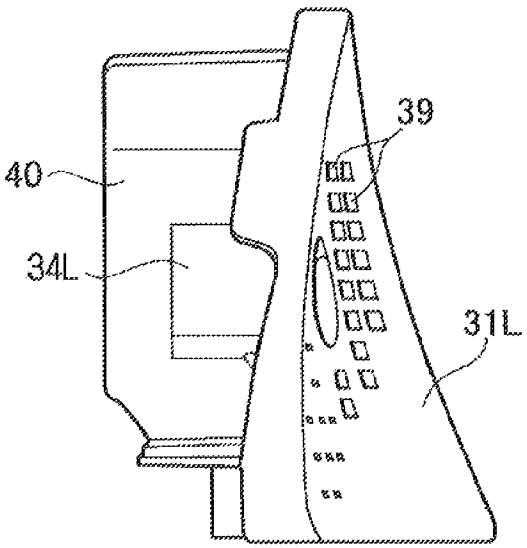
FIGS. 9A and 9B are drawings illustrating a cover composing the main water intake in the second embodiment.
Figure 9A:
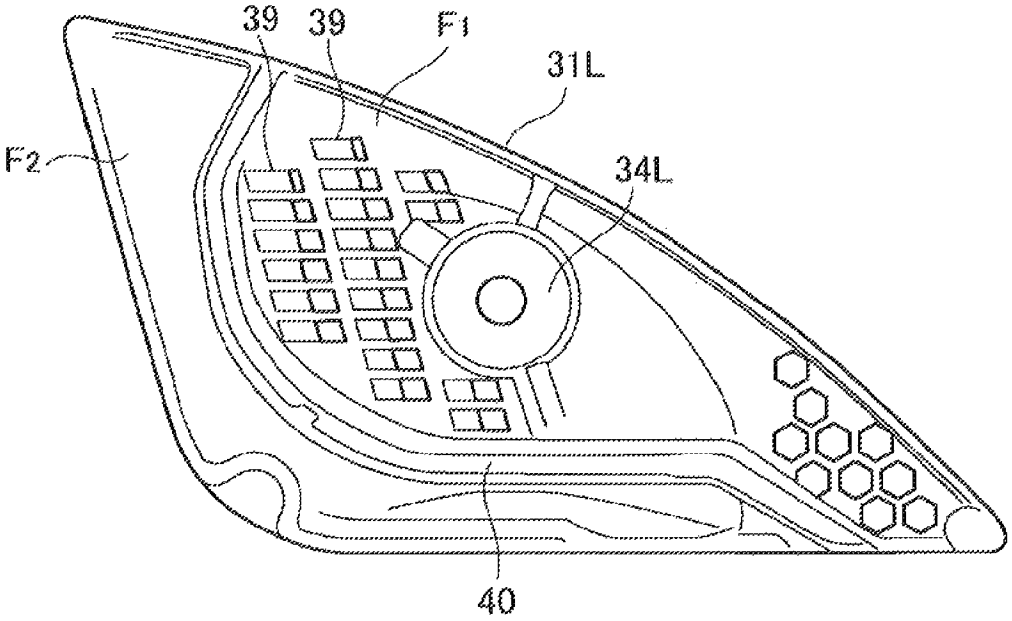

The cover 31L in the second embodiment is illustrated in FIGS. 8, 9A and 9B. A filter is provided to a large number of water inlet holes 39 formed in the covers 31L, 31R, so as to allow them to function as a filter for removing foreign matters. Similarly as described in the first embodiment, the main water inlets 30L, 30R are shaped so as to be recessed inward, and the covers 31L, 31R are attached so as to close the main water inlets 30L, 30R, respectively, to thereby configure the main water intakes 32L, 32R which correspond to the first water intakes in the context of the present invention. In other words, the main water intakes 32L, 32R are configured to form therein spaces by the cooperation of the covers 31L, 31R and the main water inlets 30L, 30R.

Figure 10:
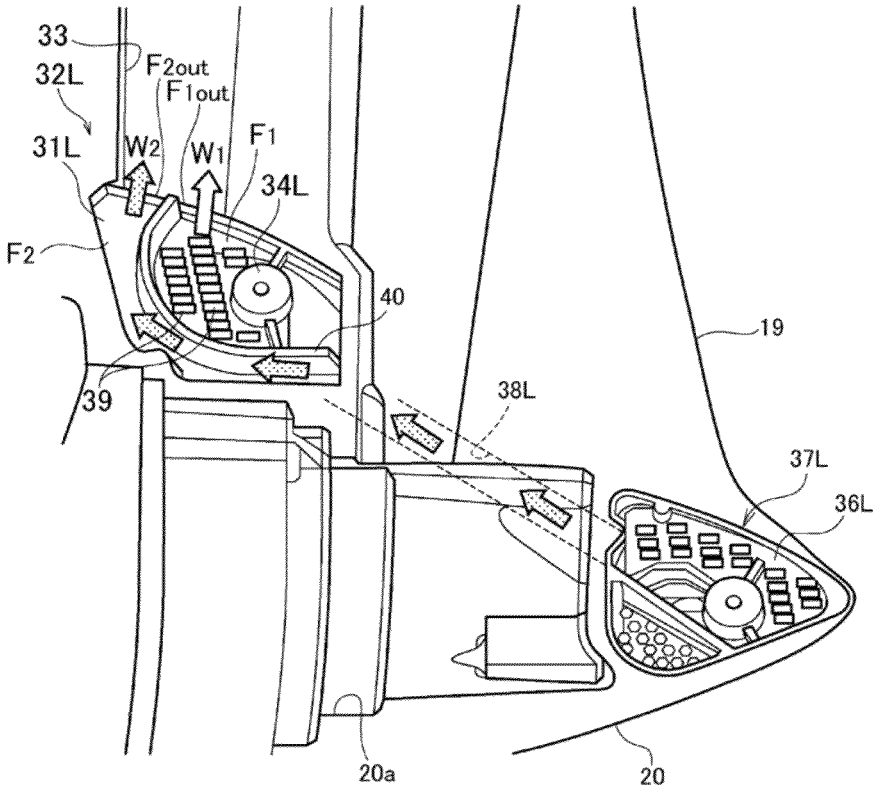
FIG. 10 is a drawing explaining positional relations among a main water intake, a sub water intake and a cooling water passage connecting them in the second embodiment.

Now, each of the covers 31L, 31R of the main water intakes 32L, 32R has a rib 40 integrally formed therein, and thereby the space in the main water intakes 32L, 32R are divided into a first passage $F_1$ and a second passage $F_2$. As illustrated in FIG. 10, the first passage $F_1$ is a passage through which the water inlet holes 39 are allowed to communicate with the cooling water passage 33, and guides water taken up through each of the water inlet holes 39 to the cooling water passage 33 (indicated by arrow $W_1$ in FIG. 10). On the other hand, the second passage $F_2$ is a passage through which the outlet of each of the cooling water passages 38L, 38R is allowed to communicate with the cooling water passage 33, and guides water taken up through each of the sub water intakes 37L, 37R to the cooling water passage 33 (indicated by arrow $W_2$ in FIG. 10). In other words, water taken up through the water inlet holes 39 of the main water intakes 32L, 32R and water taken up through the sub water intakes 37L, 37R are guided independently up to the cooling water passage 33, and combined at the cooling water passage 33. In this embodiment, the ribs 40 are formed to give a curved shape so as to allow water, which comes out from the outlets of the cooling water passages 38L, 38R, to flow in the second passage $F_2$ initially in a nearly parallel manner, and then to rise up to reach the cooling water passage 33. Note, as illustrated in FIGS. 9A and 9B, that the water inlet holes 39 formed in the covers 31L, 31R are arranged, of course, only on one side, or on the first passage $F_1$ side, of each rib 40.

Separation of the first passage $F_1$ and the second passage $F_2$ by the rib 40 is designed, as illustrated in FIG. 10, so that flows $W_1$, $W_2$ of water at the outlet of the first passage $F_1$ towards the cooling water passage 33 and at the outlet of the second passage $F_2$ towards the cooling water passage 33 are aligned nearly parallel.

Also as illustrated in FIG. 10, the main water intakes 32L, 32R are formed so as to rise rearward in the side view, and are connected at the rear portions thereof to the cooling water passage 33. The ribs 40 are extended to reach positions where the spaces in the main water intakes 32L, 32R are communicated with the cooling water passage 33. Accordingly, the outlet $F_{2out}$ of the second passage $F_2$ towards cooling water passage 33 is positioned on the downstream side, along the cooling water passage 33, of the outlet $F_{1out}$ of the first passage $F_1$ towards the cooling water passage 33. Alternatively, the ribs 40 may be extended so that the ends thereof are projected into the cooling water passage 33, so as to position the outlet $F_{2out}$ of the second passage $F_2$ on the downstream side, along the cooling water passage 33, of the outlet $F_{1out}$ of the first passage $F_1$.

In the thus-configured cooling water passage structure of the outboard motor, the sub water intakes 37L, 37R are positioned on the upstream side of stream of water during cruising of the vessel, and the main water intakes 32L, 32R are positioned on the downstream side. The sub water intake 37L on the left is communicated through the left cooling water passage 38L to the space in the main water intake 32L on the left, and the sub water intake 37R on the right is communicated through the right cooling water passage 38R to the space in the main water intake 32R on the right. In this configuration, when the cooling water pump 29 operates as the driveshaft 17 rotates, water may be taken up through the water inlet holes 39 of the main water intakes 32L, 32R, and fed through the first passage $F_1$ and the cooling water passage 33 towards the engine unit 11. On the other hand, water may be taken up through the sub water intakes 37L, 37R, fed through the cooling water passages 38L, 38R into the spaces in the main water intakes 32L, 32R, and fed through the second passage $F_2$ and the cooling water passage 33 towards the engine unit 11.

As described in the above, by adopting such double-route configuration in which the sub water intake 37L on the left is communicated through the left cooling water passage 38L to the space in the main water intake 32L on the left, and the sub water intake 37R on the right is communicated through the right cooling water passage 38R to the space in the main water intake 32R on the right, it is no more necessary to provide a pipe or water passage for directly guiding water from the sub water intakes 37L, 37R to the cooling water passage 33, and thereby a sufficient degree of freedom of layout may be ensured.

In addition, when water taken up through the sub water intakes 37L, 37R flows through the second passage $F_2$ out into the cooling water passage 33, an ejector effect may be produced to thereby assist the water supply through the first passage $F_1$ and to enhance the efficiency of water supply. The ejector effect is enhanced particularly in the high-speed region, by virtue of rise in the dynamic pressure at the sub water intakes 37L, 37R at the pointed portion of the gear case 20. In this case, by aligning the flows $W_1$, $W_2$ of water at the outlet of the first passage $F_1$ towards the cooling water passage 33 and at the outlet of the second passage $F_2$ towards the cooling water passage 33 nearly parallel, as described in the above, the ejector effect may be enhanced. In addition, by disposing the outlet $F_{2out}$ of the second passage $F_2$ towards the cooling water passage 33 positioned on the downstream side, along the cooling water passage 33, of the outlet $F_{1out}$ of the first passage $F_1$ towards the cooling water passage 33, the ejector effect may be enhanced.

In addition, by adopting such double-route configuration of the cooling water passage structure, harm of abnormal water supply may be minimized. For example, when the outboard motor 10 is swung leftward or rightward by steering as illustrated in FIG. 7, one of the main water intakes 32L, 32R will be less likely to take up water. In the illustrated example, the main water intake 32L on the left side, which directly faced to stream of water (indicated by arrow S) is able to efficiently take up water, whereas the main water intake 32R on the right, which is positioned behind the stream of water is not able to efficiently take up water. Even in this case, water may be taken up through the sub water intakes 37L, 37R, so that shortage of the volume of water may be supplemented.

In addition, even if the filter is clogged by foreign matters in water either of the main water intake 32L on the left side and the sub water intake 37L, water may be taken up through the other route, so that shortage of the volume of water may be supplemented. The same will apply also to the main water intake 32R on the right and the sub water intake 37R.

Moreover, by disposing the sub water intakes 37L, 37R at the pointed portion of the gear case 20, efficiency of water supply may be increased by dynamic pressure. In particular in the high speed region, the efficiency of water supply will decrease at the main water intakes 32L, 32R on the side faces of the casing 19, while being affected by separated flow of water, whereas the efficiency of water supply will be peaked by the dynamic pressure at the sub water intakes 37L, 37R at the pointed portion of the gear case 20, so that it now becomes possible to avoid lowering in the efficiency of water supply in the high-speed region.

While the second embodiment dealt with the case where the ribs 40 are integrally formed on the covers 31L, 31R of the main water intakes 32L, 32R, the ribs 40 may alternatively be formed integrally with the main water inlets 30L, 30R, or the casing 19. Note, however, that a problem of large difference in draft angle may arise in a possible design of forming the casing 19 with an aluminum die cast, and forming the covers 31L, 31R with a resin by injection molding, so that the ribs are more conveniently formed integrally with the covers 31L, 31R from the viewpoint of degree of freedom in design such as thinning the ribs.

Figure 11:
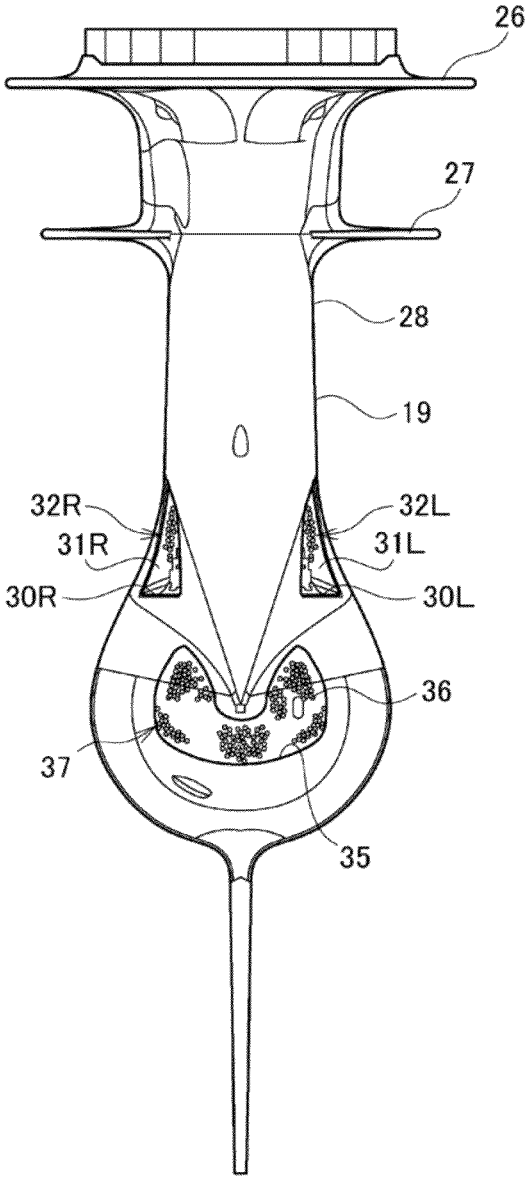
FIG. 11 is a front elevation of an outboard motor according to other embodiment.

Having described the present invention referring to various embodiments, the present invention is by no means limited to these embodiments, and may be modified in various ways within the scope thereof. For example, while the embodiments in the above dealt with the configurations where the sub water intakes 37L, 37R are independently formed on the left and right of the pointed portion of the gear case 20, another possible configuration is such as forming, as illustrated in FIG. 11, only a single sub water intake 37 at the pointed portion of the gear case 20. In this configuration, the left cooling water passage 38L which allows the sub water intake 37 to communicate with the main water intake 32L on the left side, and the right cooling water passage 38R which allows the sub water intake 37 to communicate with the main water intake 32R on the right side, are formed similarly as described in the embodiments. Note that, in the configuration of providing only a single sub water intake 37 at the pointed portion of the gear case 20, as illustrated in FIG. 11, it is preferable to dispose the sub water intake 37 so as to lie across the pointed portion of the gear case 20.

According to the present invention, since the second water intake is configured to be communicated in series through the left cooling water passage to the first water intake on the left, and the second water intake is configured to be communicated in series through the right cooling water passage to the first water intake on the right, so that a sufficient level of the degree of freedom of layout of the first water intake and the second water intake may be ensured.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. A cooling water passage structure of an outboard motor configured so that a driveshaft and a propeller shaft are connected while placing gears in between in a lower casing, wherein the lower casing has a gear case disposed to give an appearance of bullet in the front-back direction, the cooling water passage structure comprising:

first water intakes provided on side faces of a left and right of the lower casing, and above the gear case;

a main cooling water passage which guides therethrough water taken up through the first water intakes to a cooling water pump; and second water intakes provided on the side faces of the left and right of a pointed portion of the gear case, and disposed ahead of the first water intakes;

wherein the second water intakes on the left and right communicate through left and right sub cooling water passages with the first water intakes on the left and right, wherein the cooling water pump, the first water intakes on the left and right, and the second water intakes on the left and right communicate in series through the main cooling water passage and the left and right sub cooling water passages, and wherein the second water intakes on the left and right, the first water intakes on the left and right, and the main cooling water passage are disposed on the lower casing, and front of the driveshaft.

2. The cooling water passage structure of an outboard motor according to claim 1, wherein the left sub cooling water passage and the right sub cooling water passage overlap, in the side view, a housing which houses the gears in the gear case.

3. The cooling water passage structure of an outboard motor according to claim 1, wherein each first water intake is configured to form therein a space into which water is taken up, and the space in each first water intake is divided into a first passage through which water taken up through the first water intake is guided to the main cooling water passage, and a second passage through which water taken up through the second water intakes is guided to the main cooling water passage, and is configured to combine the both at the main cooling water passage.

4. The cooling water passage structure of an outboard motor according to claim 3, configured so that stream of water at the outlet of the first passage towards the cooling water passage, and stream of water at the outlet of the second passage towards the cooling water passage are aligned nearly parallel to each other.

5. The cooling water passage structure of an outboard motor according to claim 3, configured so that the outlet of the second passage towards the cooling water passage is positioned on the downstream side, along the cooling water passage, of the outlet of the first passage towards the cooling water passage.

6. The cooling water passage structure of an outboard motor according to claim 3, wherein each first water intake is configured by a water inlet formed to the lower casing so as to be recessed inward, and a cover with a filter function attached to the water inlet, and either the water inlet or the cover has provided thereto a rib which divides the space in the first water intake into the first passage and the second passage.

* * * * *